US005701921A

United States Patent [19]

Father et al.

[11] Patent Number: 5,701,921

[45] Date of Patent: Dec. 30, 1997

[54] KIT WITH TOOTHBRUSH AND TOOTHPASTE COORDINATED THAT END OF WORKING LIVES OCCUR CONCURRENTLY

[75] Inventors: Richard M. Father, Lynnwood; Bruce Douglas Ross, Seattle, both of Wash.

[73] Assignee: NACRE, Bloomingdale, Ill.

[21] Appl. No.: 409,977

[22] Filed: Mar. 24, 1995

[51] Int. Cl.[6] ..... A45D 44/18

[52] U.S. Cl. ..... 132/309; 132/310; 206/581; 222/23

[58] Field of Search ..... 132/308, 309, 132/310, 311; 222/23, 106, 192; 206/581, 277, 368, 369, 63.5, 823

[56] References Cited

U.S. PATENT DOCUMENTS

| | | | |
|---|---|---|---|
| 1,710,642 | 4/1929 | Hammet | 132/308 |
| 2,298,417 | 10/1942 | Rocca | 132/308 |
| 2,601,244 | 6/1952 | Boulicault | 132/309 |
| 2,636,644 | 4/1953 | Taylor | 222/23 |
| 2,671,424 | 3/1954 | Herring et al. | 222/23 |
| 3,542,519 | 11/1970 | Montalto | 23/253 |
| 3,613,698 | 10/1971 | Fox | 132/84 |
| 3,842,850 | 10/1974 | Sanders | 132/311 |
| 3,980,767 | 9/1976 | Chown et al. | 424/52 |
| 4,424,916 | 1/1984 | Pearson | 222/74 |
| 4,456,585 | 6/1984 | Hayes | 424/49 |
| 4,530,129 | 7/1985 | Labick et al. | 132/308 |
| 4,705,194 | 11/1987 | Judge | 222/192 |
| 4,817,826 | 4/1989 | Judge | 206/277 |
| 4,842,165 | 6/1989 | Van Coney | 222/95 |
| 4,865,481 | 9/1989 | Scales | 132/308 |
| 4,995,511 | 2/1991 | Evans | 206/362.1 |
| 5,074,414 | 12/1991 | Romana | 206/362.4 |
| 5,078,526 | 1/1992 | Corona | 132/309 |
| 5,304,009 | 4/1994 | Marshall | 132/311 |
| 5,425,591 | 6/1995 | Contreras et al. | 132/308 |

FOREIGN PATENT DOCUMENTS

| | | | |
|---|---|---|---|
| 576222 | 12/1993 | European Pat. Off. | 206/277 |
| 2220204 | 11/1974 | France | 206/581 |

OTHER PUBLICATIONS

Handbook of Engineering Fundamentals, Wiley Engineering Handbook Series, Ovid W. Eshbach ed., John Wiley & Sons, Inc, pp. 6–03, 6–27, 6–29, 6–38.

*Primary Examiner*—Todd E. Manahan

[57] ABSTRACT

A kit for carrying and storage of a toothbrush, toothpaste and associated materials and tools for dental hygiene wherein the quantity of dentifrice included is selected to be exhausted simultaneously with the end of life of the enclosed toothbrush, thus urging the replacement of the toothbrush at the proper time. The enclosed toothpaste reservoir has a small quantity of differentiated paste at the bottom which when ultimately dispensed, indicates imminent exhaustion of supply. Marker flags of color or other sensible characteristics for toothpaste and other materials are proposed.

8 Claims, 3 Drawing Sheets

KIT WITH TOOTHBRUSH AND TOOTHPASTE COORDINATED THAT END OF WORKING LIVES OCCUR CONCURRENTLY

BACKGROUND OF THE INVENTION

1. Field of Invention

The present invention relates to the equipment and chemicals used in oral hygiene, and storage thereof, and a method of reminding the user that the toothbrush has become worn-out.

2. Prior Art

Many people have need to keep or use a toothbrush away from home. Such occasions may be at work, traveling, in institutional settings, etc. Loose dentifrice, toothbrush, floss, and whatever other materials or tools required, are a nuisance to keep together, clean, keep private, carry, etc. A dental hygiene kit is appropriate for such occasions. Such a travel or storage kit may be discarded or re-supplied with a refill kit.

Dental hygienists express concern that many people use their toothbrush beyond its working life. The need for an end of life indicator for a toothbrush is recognized by the dental hygiene industry and met by the invention of a toothbrush that changes color with use and a toothbrush with a pellet of dissolvable, or color changing material in the handle. These require special manufacturing steps to produce and are subject to uncertainty of calibration and false indication from factors other than those directly related to actual brush wear. Moreover, before this disclosure, no one has suggested some sort of number of brushings counter or other usage meter. In particular, no one has suggested that there is a useful correlation between the life span of a toothbrush and the consumption of toothpaste. By packaging the elements of dental hygiene into a kit of equal life components, the working life of the brush and exhaustion of the expendables occur simultaneously. Toothpaste is the obvious expendable kit component which can be rationed proportionally to the design life of the toothbrush. No such coordinated packaging is known to have been made public before this disclosure.

Several patents are published integrally combining toothbrushes and toothpaste, collectively referred to as "fountain brushes" and are not related to the present invention.

Inventions such as U.S. Pat. Nos. 4,817,826 and 4,705,194, both by Joseph Judge, show various holders attachable to toothpaste dispensers. These are essentially un-cased brush storage racks for use in home lavatories, are not kits, and are not suitable for transportation. Nor is there any special relationship between the amount of toothpaste available and the working life of the brush.

U.S. Pat. No. 5,078,526, by Robert Corona, utilizes three separated chambers. One chamber for a storing a toothbrush, one for a toothpaste dispenser, and one for dental floss are shown. Mr. Corona's invention, while performing the functions of packaging a toothbrush, paste, and floss, has inherent characteristics that are unsanitary. The paste dispensing ports being presented deep within a well in the paste dispenser permits residual toothpaste to he deposited on the well's interior surfaces. This stray toothpaste comes from two sources, 1) smeared from the loaded brush during withdrawal from the loading station, 2) from after-flow from the release of residual pressure from the dispensing operation. It is also likely to be contaminated from the used brush. The deep well where the brush is loaded discourages proper cleaning, thus promoting unsanitary conditions within the dispenser. Furthermore, should the dispensing ports become clogged, there is no access for maintenance, nor is there any special relationship between the amount of toothpaste available and the working life of the brush.

U.S. Pat. No. 4,424,916 by Donald L Pearson is for a complex, custom designed, dispenser built into a container with holder means for several toothbrushes. This invention is pyramid shaped and designed specifically to be set upon its base, thus is not well suited for packing for travel, carrying in the pocket, or storage in an office desk. Several toothbrushes are stored within the closed containment of the case. This is an unsanitary practice when the brushes belong to several persons, and of course, since several brushes are being supplied from the same reservoir of toothpaste, there is no reliable relationship between the supply of toothpaste and the working life of the brushes. The bottom of Pearson's invention is open which permits easy access cleaning and good drying characteristics when stored on its side. However, it is intended to be set on a shelf, and when set upon its base, water is likely to collect around the bottom ring effectively sealing the case and inhibiting drying. There are no feet to raise the case off the shelf to provide ventilation of the interior. Moreover, the source of the water is likely to be contaminated drippings from the brushes.

U.S. Pat. No. 3,613,698 by Daniel W. Fox, is a complex, custom designed, toothpaste dispenser and toothbrush within a case fitted with a clip for being retained in a shirt or jacket pocket. The dispensing ports dispense paste directly onto the brush as the brush is driven from the holder by the same extractor mechanism that operates the pump piston. A custom designed toothbrush is required. One particular objection to Fox's invention is that it is not likely to vent or dry properly. In addition, being in a pocket, it is sustained at a temperature ideally suited for bacterial and fungal growth in a damp environment.

U.S. Pat. No. 4,842,165 by Robert Van Coney is a dispensing system utilizing a squeezable, flexible sided oval tube with an interior thin membrane bag containing the toothpaste. Squeezing the sides of the oval container creates internal air pressure which in turn operates on the bag and forces toothpaste from the dispenser. Check valves are employed to control the reverse flow of air into the bag and replacement air within the pressure vessel. The dispenser is not directly related to the present invention.

U.S. Pat. No. 3,542,519 by Francis J. Montalto, et al, is a time or usage indicator pellet in a cavity at the bristle end of the toothbrush. one embodiment, the pellet dissolves away, exposing the bottom of the cavity. In another embodiment, the color component leaches out causing a change of color. A third embodiment uses chemical changes leading to color change. These are intended to be set for about 3 months use in conjunction with assumptions about how many brushing sessions per day and the length of each session, how much rinsing and cleaning of the brush is done before returning the brush to storage, and in some species how long it takes the indicator pellet to dry and become dormant between usages.

The use of indicator bristles or pellets as described above requires additional steps and components of manufacture. The present invention calls for only that amount of paste provided be the amount expected to be used during the working life of the brush. An additional improvement is to have a portion of the paste inventory be of a contrasting color or some distinctive difference to be used as a flag to signal the operator that the paste supply is just about exhausted. This is a negligible cost and the packing machinery currently used is already set up for both metering an exact amount into and for loading the tubes with supply at different levels.

The present invention relies only on the number of brushings as a measure of brush usage, and does not depend on special brush treatment, design, devices, or manufacture. Traditional toothbrushes are satisfactory.

3. Objectives

Therefore, it is an objective of our invention to match the quantity of consumable materials with the wear life of the tools, encouraging timely replacement of worn out tools, in particular, to match the supply of toothpaste with the working life of the toothbrush.

It is a further objective of this invention to combine the tools and materials for dental hygiene into one convenient carrying and storage case.

It is a further objective of the invention to provide hygienic storage of dental hygiene tools and materials.

It is a further objective of the invention to provide a marker or flag indicating the imminent end of the dispensed consumables, or in the case where duplicate tools are provided, to indicate when to discard the first tool in favor of the replacement.

It is a further objective of the invention to accomplish these and other objectives using existing technology and/or products for the toothbrush, toothpaste, and dental floss components.

The invention described herein being composed of a number of cooperating elements meets these objectives while overcoming objections to the inventions cited.

SUMMARY OF THE INVENTION

A toothbrush has a working life of a certain number of brushings. Since each brushing uses a particular quantity of toothpaste, the consumption of toothpaste correlates with the expenditure of brush life. Therefore, if kit of brush and toothpaste has the quantity of toothpaste properly proportioned, the exhaustion of supply of toothpaste will coincide with end of the brush's useful life. The toothbrush is ordinary with the shape, style, size, and material of the handle and/or brush chosen to meet market and application goals and needs. The correlation is not dependent on toothpaste formulation, dispenser design, or on brush style or details. Thus, the paste reservoir may be a conventional hard tube currently used in pump-type paste dispensers, a bladder, a common squeeze tube, or a resilient-wall container.

The correlation aspect of the invention will generally be practiced by combining a brush and dispenser containing the appropriate quantity of paste in any presentation requiring both to be purchased together such as a blister pack or carton fixing the brush and paste as a set. However, it is not necessary to physically attach the brush and dispenser, only in some manner to direct that the two be purchased or used together forming a de-facto coordinated set. A sales promotion, advertising, or even direction on either the brush, paste dispenser, or both urging the purchaser to buy or use the other for the reasons set forth in this invention description constitutes a coordinated combining of the individual products. A discount or promotional incentive in conjunction with the coordinated purchase clearly brings them together and is within the scope of this invention.

It is anticipated that the set generally be packed in a case serving as a storage and/or carrying case as described further herein. Such a case has at least two chambers set side by side separated by a condominium wall. One chamber is to store the paste supply and the other for the brush. Separation walls promote hygiene by suppressing the migration of unsanitary drippings or vapors. A third chamber in the lid serves as a storage place for dental floss or other dental hygiene tools.

By judicious placement of a small quantity of the toothpaste admixed with a distinctive color in the dispenser, the imminent exhaustion of toothpaste supply and brush life is announced when the color changes.

The colored portion remains in separation from the main body of toothpaste by virtue of the viscosity of the toothpaste and the absence of a stirring mechanism. Incidental mixing at the interface caused by the activity of dispensing the toothpaste, if it occurs, will not diminish the usefulness of the colored portion as an indicator flag signaling the imminent exhaustion of the toothpaste supply.

There exist a market resistance to single-use, throw-away, consumer goods, so the product engineering should include the potential for inserting a re-fill kit with minimal packaging to discard. Also, the kit may be provided with two brushes and the reservoir filled approximately ½ with one color, the other half with another color, and a small portion of a third color as described above. The first color change announcing the end of life for the first toothbrush.

While color changes are preferred as an indicator flag, other distinctions such as a change of flavor, odor, texture, viscosity, foaming, swelling, shrinking, or combinations thereof will provide the necessary sensible indication.

It is obvious that the innovation utilizing an indicator flag disposed within toothpaste is applicable to any viscous material dispensed in a manner similar to toothpaste by whatever means or device used for dispensation.

Figure 2:
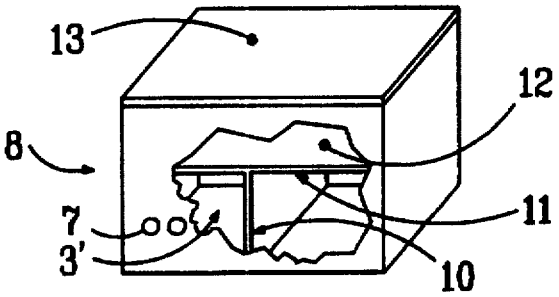
FIG. 2 illustrates the cover portion of the case assembly of FIG. 1.

The following table is an index of the detail ID numbers found in the disclosure and drawings:

1. Kit case
2. Condominium wall separating toothpaste and toothbrush chambers
3. Toothbrush chamber
3'. Toothbrush chamber in lid assembly
4. Pump assembly
5. Cartridge assembly
6. Vent hole, pressure relief
7. Vent holes, drying
7*a*. Vent/drain hole
8. Cover assembly
9. Telescoping section
10. Condominium wall in cover separating toothpaste and toothbrush chambers
11. Condominium ceiling/floor in cover forming an accessory chamber above
12. Accessory storage chamber (for floss, picks, etc)
13. Accessory chamber lid
14. Toothbrush
15. Nozzle, dispensing
16. Dispensing tube, portion of,
17. Dispensing tube extension
18. toothbrush
19. Brush Bristles
20. Toothpaste
21. Support foot
22. Toothpaste portion without marking flag
23. Toothpaste portion with secondary marking flag
24, 24*a*, 24*b*. Toothpaste portion with primary marking flag
25. Interface between toothpaste portions
26. Interface between toothpaste portions
27. Moving plug
28. Pump piston
29. Separation disk
30. Gap
31. Separation plug
32. Barrier
33. Barrier cutter
34. Attachment
35*a*, 35*b*. Check valves
36. Air pressure applied to container bag

DETAILED DESCRIPTION OF THE PREFERRED EMBODIMENTS

Figure 4:
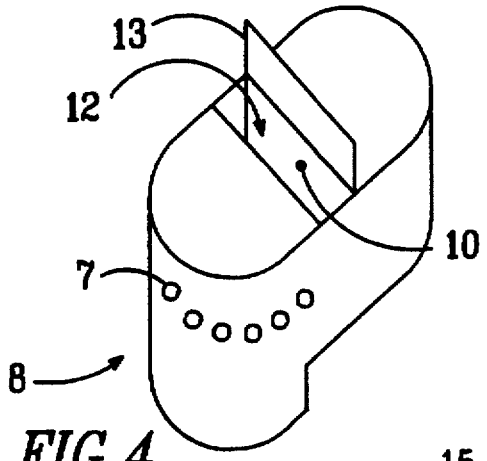
FIG. 4 illustrates the cover portion of the case assembly of FIG. 3.
Figure 1:
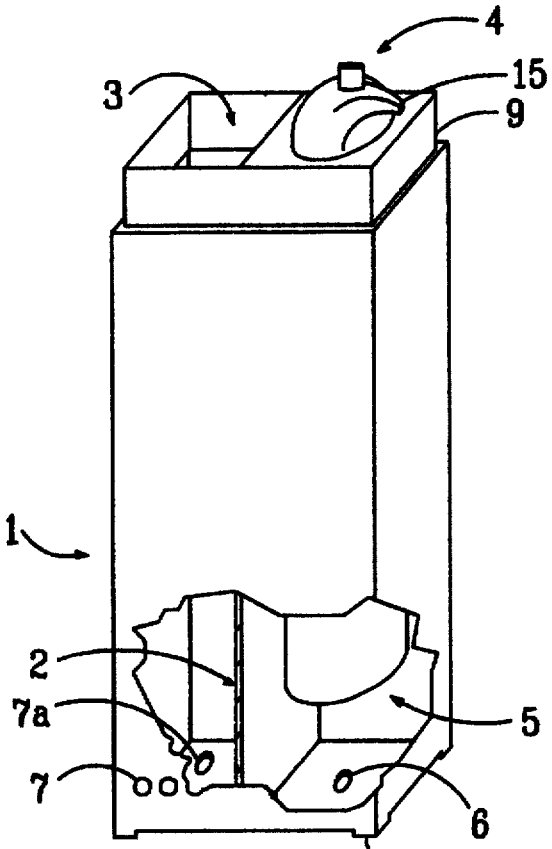
FIG. 1 illustrates the preferred embodiment using a standard cartridge of toothpaste, a pump dispenser, and a rectangular case.
Figure 3:
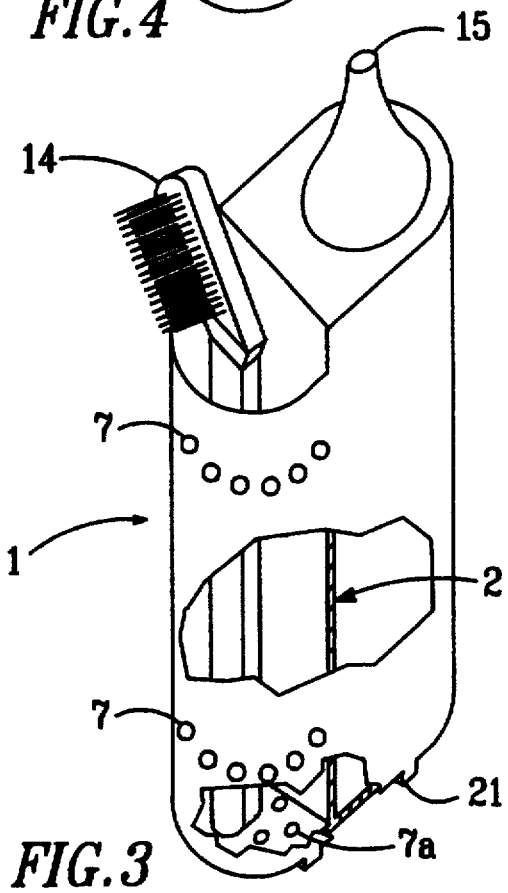
FIG. 3 illustrates an alternate embodiment using a soft-sided, squeezable, oval case.

A carrying/storage case for toothpaste, toothbrush, dental floss, or other equipment comprising an outer case, interior dividing wall, toothpaste container/dispenser, and place for floss or other implements is illustrated in FIGS. 1 and 3. The respective covers are illustrated in FIGS. 2 and 4.

Referring to FIG. 1, case 1 is either a composite of sheet stock or molded of suitable material. A rectangular form is shown, but a roundish shape is suitable. Wall 2 is constructed within to separate the case into two long tubular chambers, one chamber, 3, is for the storage of a common toothbrush. The other has a conventional paste dispenser, 4, therein. Figure I shows the dispenser 4 as a pump type with a cylindrical reservoir 5. It must be noted here that the reservoir may be a collapsible form such as a bladder or even a conventional tube as long as it is coordinated with the brush as described in this disclosure. Vent 6 is to equalize pressure as the toothpaste is expelled. Vents 7 in both the case and its cover are of sufficient size, number, and position to adequately ventilate the brush chamber and dry the brush. Vent 7*a* is a combined vent/drain for the toothbrush chamber. The toothpaste supply means may be detachably mounted in the case so that the supply may be replenished by replacement of either the entire dispenser or just the reservoir component.

Case 1 (or equivalently, cover 8) has a section of reduced or enlarged section 9 to permit telescoping of the cover and case to close the kit case assembly.

Cover 8 (FIG. 2) is fitted internally with a wall 10 placed such that when cover 8 is in place on case 1, wall 2, and hence the toothbrush chamber 3 is in effect extended as 3' into the lid. While such an extension is not absolutely necessary to the invention, it provides a space to have the toothbrush extend out of the main body 1 of the kit for easier extraction from its storage chamber. Wall 10 also adds to the strength of the cover and helps maintain cleanliness of the paste dispenser by separating the brush chamber from the paste dispenser head.

Internal closure 11 within cover 8 defines the upper ends of the two chambers and is the floor of the accessory compartment 12. The assembly is finally closed with hinged cap 13.

While the FIGS. show a built-in dispenser, the invention anticipates the case being used as a simple storage box holding the toothbrush and an unattached ordinary tube of toothpaste.

FIG. 3 illustrates an embodiment of the invention using soft or squeezable sides. The paste may be directly contained by the kit walls or within an inner bag liner. FIGS. 3 and 4 show feet 21 on the bottom for standing upright. It is also practical to stand the case on its cap, in which case, feet would be formed integrally with the top (now bottom) of the cap. FIG. 3 shows the bottom end formed integrally with the side walls. Obviously, a plug will work equally well or in the cap down configuration a pinch or crimp seal is appropriate. The choice is determined by manufacturing and/or cost considerations.

Figure 14:
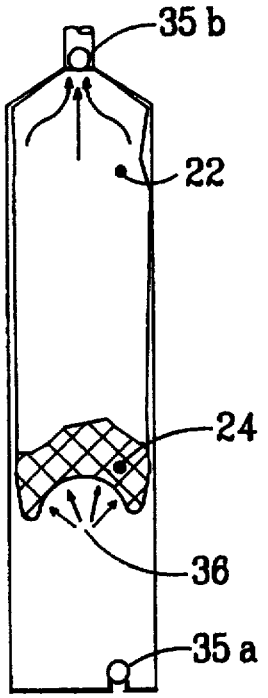
FIG. 14 is a cut-away view of the essential elements described in reference U.S. Pat. No. 4,842,165 having the toothpaste contained in a bag and the flag portion at the bottom of the bag, and showing the movement of the toothpaste therein.

The volume of the contents dispensed by squeezing must be replaced during use. It is envisioned that simply drawing air in through the dispenser delivery tube 15 will suffice. This brings up a potential for drawing in unsanitary contaminants. Since toothpaste contains disinfectant, it may not be a serious problem, but if it is, check valves may be incorporated. Reference U.S. Pat. No. 4,842,165 teaches one method of using check valves and flexible bag containing the toothpaste to avoid drawing air into the paste reservoir and for other purposes. The present invention can be practiced as an independent improvement on U.S. Pat. No. 4,842,165 as shown in FIG. 14.

Common to all embodiments, are short legs 21 on the bottom of the base to provide air circulation under the assembly to dry moisture thereunder resulting from water running down the sides of the container from wet hands etc. Such water is not only unsanitary and unsightly, it may damage the finish on a storage shelf surface. The feet also provide a drain channel for water from within the toothbrush chamber.

Also common to all embodiments, is that the quantity of toothpaste packed within is intended to be exhausted coincidentally with the end of the useful life of the brush, which is expected to be 180(twice daily) to 270 (thrice daily) brushings depending upon the recommendation of the brush manufacturer. To reduce costs and increase consumer acceptance, the quantity of paste may be doubled and two brushes be supplied with the kit.

The proper amount of toothpaste to be packaged in the kit is calculated from manufactures', the ADA's, or other knowledgeable sources' recommendations of the amount of paste to apply to a brush and brush life expressed in numbers of effective brushings anticipated before wear-out. The formula for calculation being (amount of paste to package) =(number of brushings)×(amount of paste per brushing).

Figure 15:
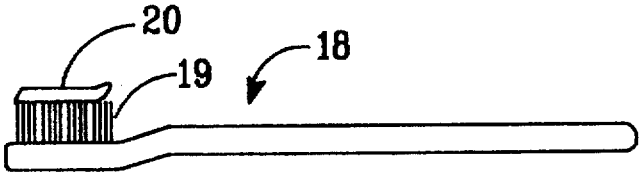
FIG. 15 illustrates the amount of toothpaste to apply to a toothbrush.

FIG. 15 shows the amount of paste to apply to a toothbrush. Toothbrush 8 having bristles 19 receives a slug of toothpaste 20 approximately the length of the bristle. The slug of toothpaste has a cross section nearly equal to the cross section of the orifice of the dispenser from which it was extruded.

Many toothpaste packages and advertisements show a toothbrush with paste and ready for use. The usual amount shown on the brush is a strip approximately the length to the brush head. These illustrations depict the maximum amount practical to be applied to a brush and may be deemed as instructive in the absence of other instruction or depictions. The exact volume applied is directly related to the length of the strip and the cross sectional area of the strip. The cross section is determined by the dispenser's nozzle size. It is a simple mater to calculate the volume from the chosen dispenser and brush dimensions or the measure the volume (or weight) of a sample, or several samples directly by applying toothpaste to the selected bush from the selected dispenser.

Pump type dispensers automatically dispense a uniform amount of toothpaste determined by the pump dimensions. Of course, it is possible to fail to completely depress the pump actuator, but most users will simply push the actuator until it comes against a mechanical stop, thus dispensing the designed volume of paste.

Brush life is often described on brush packaging, typically "discard after 3 months" or "brush after each meal and discard brush after 3 months use of use"; approximately 180 to 270 brushings. Brush life is not wholly dependent upon mechanical wear of the bristles. After several months of use, there is generally an accumulation of debris and bacteria. Many brushes contain biocidal ingredients which are exhausted by approximately 4 to 6 months of use.

Brushes typically have bristle heads ¾ to 1⅛ inch in length and a smaller variation in width. In a test, brushes and toothpaste were purchased off-the-shelf and tested for how much toothpaste was applied along the length of the bristles. The smallest adult brush was ¾ inch long and was loaded 150 times from a 6.4 ounce tube of toothpaste, i.e. 0.0426 ounces/load. The largest adult brush was 1⅛ inch long and was loaded 110 times from a similar 6.4 ounce tube, i.e. 0.0581 ounces/load.

Recalculating with the formula above, the amount of toothpaste to provide 270 brushing with a ¾ inch brush is 11 ounces, and a 1⅛ inch brush will use 15 ounces when the slug is the length of the brush. The corresponding FIGS. for 180 brushings is 7.7 and 10.5 ounces.

It is the responsibility of the kit manufacturer in cooperation with the brush and toothpaste manufacturers to chose the appropriate parameter values in calculating the amount of toothpaste to pack into to the kit.

In addition to the basic computation shown above, other factors, basically marketing considerations, may modify the amount of paste to package. Typically, these would be:

1. Reduce the amount based on sales, market survey, or empirical data identifying how much toothpaste the average user puts on his brush despite advertising, instruction, or teaching otherwise.
2. Reduce the amount to provide a margin of safety for users that apply less than the recommended amount of paste. Probably reduce to 50 to 75% of the raw calculated value.
3. Reduce the amount to promote more kit sales.

These modifications to the amount calculated by the formula are based on market considerations well known or easily determined by persons of ordinary skill in the art of manufacturing, packaging, or distributing toothpaste and brushes.

The motion of the viscous product, toothpaste, within a dispenser is controlled by the physics of fluid flow, rehology, and other specifics peculiar to the particular package and toothpaste chosen to incorporate into the invention. The discussion following teaches the pertinent art, but it is expected that the practitioner will have adequate fundamental knowledge to recognize the limitations of the teaching and that some experimentation is required to verify or adjust the mathematical models. The principles and limitations of the theory are well known in fluid engineering and food and cosmetics packaging machine design and operation and should be part of the core knowledge of the subject.

The theory of motion of fluids over a surface or through tubes is well known and may be found in various texts on fluid flow. These texts also indicate that there is uncertainty in their application to actual field situations,and some experimentation and/or field testing is in order.

The profile of the flow velocity of viscous fluids through tubes is described by the formula $v=(1-(2r/D)^2)/V_{max}$. Where v is the velocity of a thin cylinder of fluid of radius r, D is the diameter of the tube, and Vmax is the maximum speed of any portion. This formula indicates that 1) the velocity at the tube wall is zero and relatively small for a distance from the wall and, 2) the average velocity is ½ the maximum velocity. The slowly moving portion along the wall is essentially attached to the wall and is known as the boundary layer. The usual definition of boundary layer is "that portion adjacent to the wall where laminar flow takes place", and there are appropriate formulas published to estimate boundary layer thickness. This definition obviously assumes non-laminar flow generally in the tube. In low Reynolds' Number cases, (ie, total laminar flow), the definition fails. Two distinctly different and arbitrary alternate definitions are appropriate in laminar flow situations. 1) Boundary layer is that portion which the velocity is less than 20% of the maximum velocity. 2) Boundary layer is that portion adjacent to the wall wherein less than 10% of the total volume is moved along the tube."

Figure 6:
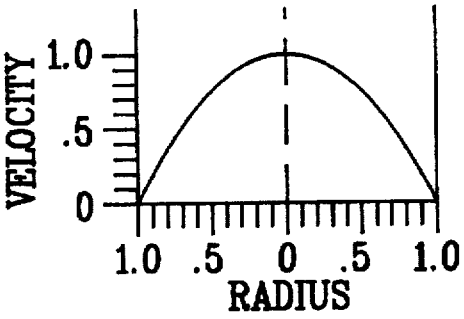
FIG. 6 is a graph of the velocity of flow of a viscous fluid within a tube at various radii.

FIG. 6 is a graph of the velocity profile with normalized axes.

Figure 7:
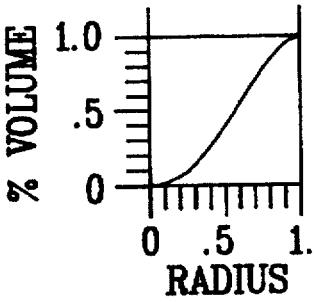
FIG. 7 is a graph of the volume of flow of a viscous fluid within a tube at various radii.

FIG. 7 is a graph of the volume in motion within various radial distances.

The process used calculate the values plotted in FIG. 7 is known as "integration", which may be accomplished by purely mathematical processes or a good approximation by totalizing the volume flowing in thin cylinders of radius r. The volume of interest for boundary layer uses is that flowing in a small length of a radial line just inside the tube wall.

FIG. 6 shows the boundary layer to be the 11% of the radius closest to the tube wall. FIG. 7 shows it to be the 15% of the radius closest to the wall. For practical purposes these two FIGS. are equivalent.

Calculations indicate that the Reynolds' number of the fluid motion in the present invention is significantly less than 1. Therefore, the flow may be considered laminar. Note, RN <2000 is the usual criteria of indicating laminar flow.

The invention differs from strictly tubular flow in that as piston 28 is moved up and down by the operator, expelling toothpaste sporadically, the toothpaste is pushed up by the bottom plug 27 which scrapes the sides and dislodges the boundary layer, forcing it under the lower portion of the toothpaste column in the reservoir. Also, flow is necked down as it moves toward the dispensing tube 16 or 17.

Figure 5:
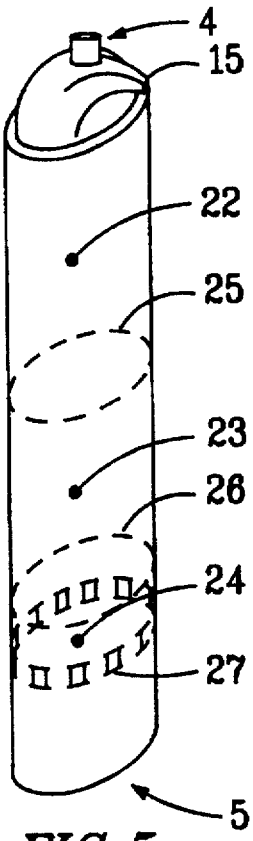
FIG. 5 illustrates the pump/reservoir cartridge portion of the assembly of FIG. 1 and the use of different colors as action flags therein.

FIG. 5 illustrates the use for two or more separated volumes of paste 22, 23, 24, differing in some sensible manner such as color or flavor. When the portion of paste presented to the outlet is exhausted, the next portion is dispensed. Interface 25 is positioned at mid-supply to indicate time to replace a worn toothbrush. Interface 26 is positioned at approximately 10% remaining, to indicate imminent exhaustion of the toothpaste supply, hence replace or resupply the kit.

The dispenser 5 shown in the drawings is a generic tubular pump type readily available on the open market. Only the essential elements are shown. Not shown, but implicit in the description and found in the functional models, are return springs at the piston 28, seals between piston 28, plug 27 and the tube wall, and a spring catch mechanism providing a ratchet function allowing the plug 27 to move only toward the piston. The tube and bag shown in the drawings is for illustration. The paste supply may be contained in a tube or bag as shown or directly contained within the kit paste chamber.

Figure 9:
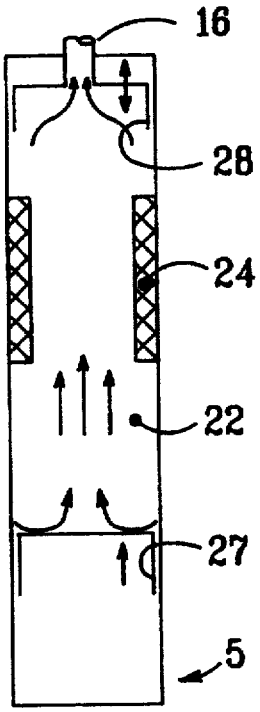
FIG. 9 is a cut-away view of the essential elements of the cartridge having the flag portion along the tube wall, an also showing the movement of the toothpaste therein.
Figure 8:
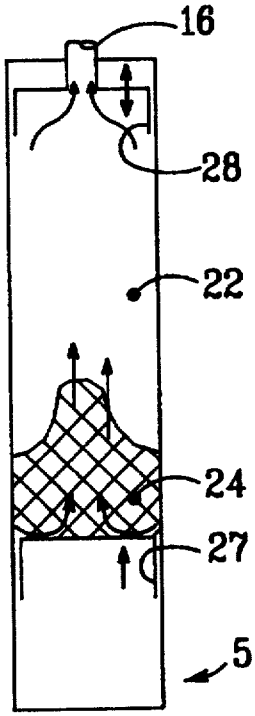
FIG. 8 is a cut-away view of the essential elements of the cartridge having the flag portion in the bottom, and also showing the movement of the toothpaste therein.

The species shown in FIG. 8 illustrates the result of the scraping action of the plug which causes the bottom portion, shown containing a color flag 24, to rise prematurely. The result is a) the color appears earlier than expected, b) the color appears as a colored core surrounded by uncolored paste, c) when the plug passes the initial upper surface of the flag portion 24, uncolored toothpaste 22 is tucked under the colored slug. This does not constitute a failed design, only more uncertainty in calibration and some means must be employed to make the core visible. Some of the references teach formulation of translucent toothpaste which would allow the core color to show through. Also, the action of cutting off of the extrusion ribbon, leaving a slug on the toothbrush, exposes the core. If not noticed before, the color may be seen in the foam discard after brushing. Flavor indicators will be completely effective, Placing the color portion along the side wall as shown in FIG. 9 eliminates the formation of the central colored column described in conjunction with FIG. 8. Some of the inner colored portions will smear-flow toward the outlet. However, by adjusting the thickness and position of the color cylinder, the presentation of color will be nil or unimportant. The colored scrapings will accumulate at the bottom next the moving plug and eventually be the only color at the nozzle. The total volume/per unit length for the colored paste 24 in the shell portion is thickness×average radius×pi, which in terms of radius is $(R-r)*((R+r)/2)*3.1416$ and the volume of the volume of the core within the shell 24 is $3.1416*(r)$. Further combination and reduction of these formulas yields the ratio formula as $(R-r)*(R+r)/(2*r)$. When the shell thickness (R−r) is 10% of the tube radius, the ratio is 1.05 This number is the rate of infilling at the bottom by scraping as the plug moves. FIG. 7 may be used in place of solving the forgoing formulas.

Tests show that for a 1¼ inch diameter dispenser designed according to the illustration of FIG. 9, a colored portion with dimensions approximately 1/10 inch thick, 1 ½ inch long, and placed ½ inch below the piston is satisfactory.

The teachings of FIGS. 8 and 9 may be combined.

Figure 10:
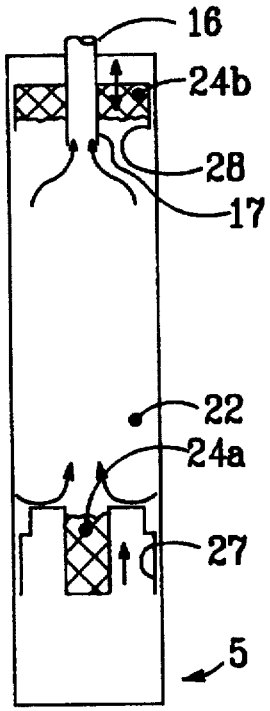
FIG. 10 is a cut-away view of the essential elements of the cartridge having the flag portion in shielded wells, an showing the movement of the toothpaste therein.

FIG. 10 shows the colored portions 24a, 24b shielded from being dragged by the flow of the primary volume of toothpaste. Both 24a and 24b are needed to be used simultaneously. As the dispensing tube extension 17 enters the well containing portion 24a, the piston 24b in the piston flows down along the outside of the extension tube 17 and into its interior along with paste from 24b. A small amount of uncolored paste will usually be just under the colored portion 24b and will show as a few dispensations with an uncolored outer sheath. This does not interfere with the useful operation of the invention.

Figure 11:
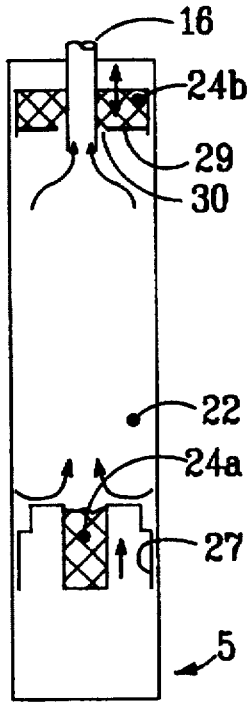
FIG. 11 is a cut-away view of the essential elements of the cartridge having the flag portion in sheltered wells, and showing the movement of toothpaste therein.

FIG. 11 is of the same species with the addition of a physical barrier 29, usually a disk or cone which effectively prevents rheological drag of colored portions by passing uncolored flow. When the plug enters the piston, toothpaste is expelled from the piston cup through gap 30. Note a flexible, sock attached the tube wall could be used similarly in the species of FIG. 9. the sock being deformed and emptied by the passing plug.

Figure 12:
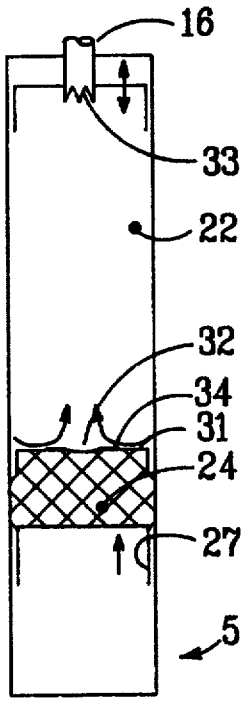
FIG. 12 is a cut-away view of the essential elements of the cartridge having the flag portion in a frangible closure, and showing the movement of the toothpaste therein.

FIG. 12 uses two plugs, 31 enclosing the colored portion. There will be a slight negative pressure developed across the upper plug as the plugs are drawn toward the dispensing end of the tube. To prevent uncolored paste 22 from being drawn into the colored paste chamber, the opening is closed with a frangible barrier 32 which is cut open by cutter 33, admitting the colored contents to the dispensing tube.

Figure 13:
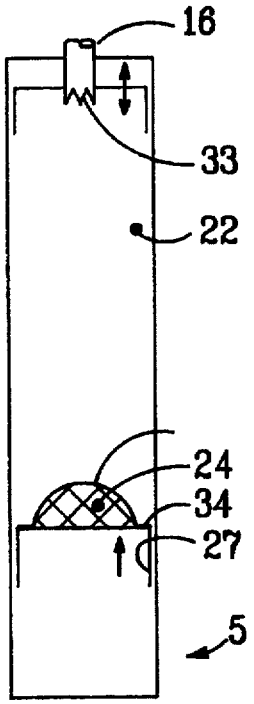
FIG. 13 a cut-away view of the essential elements of the cartridge having the flag portion in a frangible enclosed chamber.

The species of FIG. 13 encloses a portion of colored toothpaste 24 in a bubble 32 attached 34 to the plug 27. The bubble is opened by cutter 33.

FIG. 14 shows a bladder containing both portions of toothpaste. With the assistance of check valves 35a and 35b, air pressure is formed when the outer shell is squeezed forcing the bottom of the bladder toward the outlet. The bottom ascends within the case, inverting upon itself. The action mimics the plug of the tubular dispenser described. The flow and rheological actions are also similar except that there is no scraping action to tuck the boundary layer under the bottom paste. Instead, the side portions are lifted by the folding to the bladder and are squeezed by the air pressure 36 forcing the inverted inner wall against the outer case. With these differences in mind, the theoretical and practical teachings presented herein and known in the art can be applied to bladder type dispensers. There is a potential for mixing due to kneading action during squeezing the case, but tests indicate that the undesirable mixing is tolerable and does not render the invention unworkable as a species of the present invention.

FIG. 14 shows an air augmented squeeze type bladder system. It is also practical to replace air valve 35a with a vent and replace the nozzle assembly with a draw pump which will draw out the bladder contents. the bladder will function as shown, but using natural atmospheric pressure to collapse the bladder.

To practice the invention, the formulas and characteristics described above are to be combined and tested to ensure that the colors, flavors, or other indicators are dispensed sequentially.

Packaging machinery to place the marked portions in place as shown is readily available and within he existing capability of the toothpaste packaging industry.

It is obvious that when dispensing a viscous liquid with a conventional pump system, various volumes will not significantly mix during use, being held in place by a combination of their viscosity and a lack of a mixing means such as a bubble. This is especially true when the reservoir is closed with the usual follower type end seal 27. The same is true for the dispenser of FIG. 14. However, when the paste is contained directly within the case is a large ullage space, i.e a bubble, formed as the paste is used and replaced with air. This has no effect on the coordinated-quantity part of the present invention.

The embodiment of FIG. 3 may be practiced using a soft walled, resilient, squeezable construction. The teachings shown for the colored flag portions will fail due to mixing unless the colored portion has a significantly higher viscosity than usual causing it to cling strongly to the walls. A preferred solution to overcome mixing is to enclose the flagged portion in a tough bag or tube within the dispenser. When the primary portion is exhausted, the reserve portion is located by feel through the flexible sides and squeezed to burst the reserve container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there is illustrated preferred embodiments of the invention.

It is recognized that one skilled in the art will perceive other embodiments and variants in the spirit and nature of the invention. It is intended that such embodiments and variants be included within the monopoly extended by patent.

We claim:

1. A kit comprising, in combination:

a dispenser having a dispensing nozzle and a supply of toothpaste disposed therein; and at least one toothbrush having a defined useful working life;

said toothpaste and said at least one toothbrush being associated as a set wherein the quantity of the supply of toothpaste is determined to be the minimum amount required to perform approximately the number of brushings determined to be said defined working life of the at least one toothbrush.

2. The kit of claim 1 wherein said supply of toothpaste comprises first and second portions of toothpaste, said first and second portions being disposed within said dispenser so as to be dispensed therefrom essentially sequentially, wherein the portions are distinguishable from each other by at least one said portion further consisting of at least one differentiating characteristic selected from the group consisting of color, flavor, odor, and texture; and wherein said first and second portions have different viscosities such that substantial mixing thereof is inhibited.

3. The kit of claim 1 further comprising a storage case having compartments for said dispenser and said at least one toothbrush.

4. A kit comprising, in combination:

a storage container having a vertical wall therein so as to divide said container into first and second container chambers, each chamber having upper and lower ends, said first chamber having a dispensing nozzle at the upper end thereof and said second chamber having a substantially open upper end;

At least one toothbrush, each toothbrush having a determined useful working life, disposed within said second container chamber;

a quantity of toothpaste disposed within said first container chamber; wherein said quantity of toothpaste is substantially the quantity of toothpaste to be expended in utilizing said at least one toothbrush for substantially the useful working life thereof;

a base attached to the lower ends of said first and second container chambers; and a cover having a closed upper end and a open lower end removably attached to said container, said cover being divided into first and second cover chambers by a vertically disposed wall, said cover cooperating with the upper ends of said first and second container chambers such that said first cover chamber forms a cap for said dispensing nozzle and said second chamber forms a cap for said at least one toothbrush as an extension of said second container chamber.

5. The kit of claim 4 wherein said supply of toothpaste comprises first and second portions of toothpaste, said first and second portions being disposed within said dispenser so as to be dispensed therefrom essentially sequentially, wherein the portions are distinguishable from each other by at least one said portion further consisting of at least one differentiating characteristic selected form the group consisting of color, flavor, odor, and texture; and wherein said first and second portions have different viscosities such that substantial mixing thereof is inhibited.

6. A kit comprising, in combination:

a storage container having a vertical wall therein so as to divide said container into first and second container chambers, each chamber having upper and lower ends, said first chamber having a dispensing nozzle at the upper end thereof and said second chamber having a substantially open upper end;

a supply of toothpaste disposed within said first container chamber;

at least one toothbrush disposed within said second container chamber;

a base attached to the lower ends of said first and second container chambers;

a cover having a closed upper end and a open lower end removably attached to said container, said cover being divided into first and second cover chambers by a vertically disposed wall, said cover cooperating with the upper ends of said first and second container chambers such that said first cover chamber forms a cap for said dispensing nozzle and said second cover chamber forms a cap for said at least ore toothbrush as an extension of said second container chamber;

a supply of dental floss; and an additional chamber attached to said closed upper end of said cover, said dental floss being disposed within said additional chamber, and said additional chamber having a closable lid for permitting access to said dental floss.

7. The kit of claim 6 wherein said at least one toothbrush has a determined useful working life; and wherein the quantity of toothpaste supplied is substantially the quantity of toothpaste to be expended in utilizing said at least one toothbrush for substantially the useful working life thereof.

8. The kit of claim 6, wherein said supply of toothpaste comprises first and second portions of toothpaste, said first and second portions being disposed within said dispenser so as to be dispensed therefrom essentially sequentially, wherein the portions are distinguishable from each other by at least one said portion further consisting of at least one differentiating characteristic selected from the group consisting of color, flavor, odor, and texture; and wherein said first and second portions have different viscosities such that substantial mixing thereof a inhibited.

* * * * *